US010427219B2

(12) United States Patent
Tobita

(10) Patent No.: US 10,427,219 B2
(45) Date of Patent: Oct. 1, 2019

(54) APPARATUS FOR CONTINUOUSLY CUTOFF MACHINING SINTERED MAGNET BLOCKS

(71) Applicant: SHIN-ETSU CHEMICAL CO., LTD., Tokyo (JP)

(72) Inventor: Teruaki Tobita, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 513 days.

(21) Appl. No.: 15/273,291

(22) Filed: Sep. 22, 2016

(65) Prior Publication Data

US 2017/0087637 A1 Mar. 30, 2017

(30) Foreign Application Priority Data

Sep. 30, 2015 (JP) ..... 2015-192779

(51) Int. Cl.
*B22F 3/24* (2006.01)
*B22F 3/20* (2006.01)
*H01F 41/02* (2006.01)

(52) U.S. Cl.
CPC ..... *B22F 3/24* (2013.01); *B22F 3/20* (2013.01); *H01F 41/0253* (2013.01); *H01F 41/0266* (2013.01)

(58) Field of Classification Search
CPC ... B28B 5/022; B22F 3/24; B22F 3/20; H01F 41/0253; H01F 41/0266
USPC ..... 125/13.01, 20, 38; 451/182, 336, 337
See application file for complete search history.

(56) References Cited

U.S. PATENT DOCUMENTS 4,315,494 A * 2/1982 DiPlacido ..... B28D 7/043 125/13.01
4,787,178 A * 11/1988 Morgan ..... B26D 7/20 198/434
4,903,680 A * 2/1990 Chiuminatta ..... B23Q 9/0014 125/13.01
4,941,290 A * 7/1990 Holyoke ..... B24B 7/12 451/182
5,085,008 A * 2/1992 Jennings ..... B24B 7/22 125/12
5,361,544 A * 11/1994 Yang ..... B24B 1/00 451/130
5,392,758 A * 2/1995 Rognon ..... B23D 47/005 125/13.01
5,664,553 A * 9/1997 Chiuminatta ..... B28D 1/045 125/13.01

(Continued)

FOREIGN PATENT DOCUMENTS

JP 2010-110851 A 5/2010
JP 2012-708 A 1/2012

*Primary Examiner* — George B Nguyen
(74) *Attorney, Agent, or Firm* — Westerman, Hattori, Daniels & Adrian, LLP

(57) ABSTRACT

The continuous cutting apparatus includes a guide rail (5), an extruder (3) for extruding and moving forward a series of sintered magnet blocks (1) on the guide rail (5), a holder plate (6) for holding the magnet blocks in place, and a plurality of OD blades (2) for cutoff machining the magnet blocks into magnet pieces. The cutting apparatus is capable of continuously cutoff machining magnet blocks each into a multiplicity of magnet pieces of desired shape and/or size, achieving a significant increase in productivity and ensuring efficient production of magnet pieces.

7 Claims, 8 Drawing Sheets

(56) References Cited

U.S. PATENT DOCUMENTS

| | | | | |
|---|---|---|---|---|
| 6,463,920 | B1 * | 10/2002 | Kondo | B24D 3/08 125/11.22 |
| 6,595,094 | B1 * | 7/2003 | Kondo | B27B 5/30 83/471.2 |
| 6,769,423 | B1 * | 8/2004 | Zhang | B28D 1/048 125/13.01 |
| 7,516,527 | B1 * | 4/2009 | Zuzelo | B23D 47/02 125/12 |
| 8,425,279 | B2 * | 4/2013 | Gurley | B28D 5/024 125/13.01 |
| 8,567,383 | B2 | 10/2013 | Sato et al. | |
| 2010/0112904 | A1 * | 5/2010 | Sato | B24B 27/0658 451/28 |
| 2011/0162504 | A1 * | 7/2011 | Doi | B28D 1/24 83/676 |
| 2011/0165822 | A1 * | 7/2011 | Doi | B28D 1/24 451/28 |
| 2011/0312255 | A1 | 12/2011 | Akada et al. | |

* cited by examiner

APPARATUS FOR CONTINUOUSLY CUTOFF MACHINING SINTERED MAGNET BLOCKS

CROSS-REFERENCE TO RELATED APPLICATION

This non-provisional application claims priority under 35 U.S.C. § 119(a) on Patent Application No. 2015-192779 filed in Japan on Sep. 30, 2015, the entire contents of which are hereby incorporated by reference.

TECHNICAL FIELD

This invention relates to a cutting apparatus for continuously cutoff machining a series of sintered magnet blocks of rare earth alloy, for example, each into a multiplicity of magnet pieces of desired shape and/or size in an efficient manner.

BACKGROUND ART

Nowadays, by virtue of their superior magnetic properties, rare earth sintered magnets, typically neodymium and samarium-based magnets are widely used in motors, sensors and other devices to be mounted in hard disks, air conditioners, hybrid vehicles, and the like. In the automobile field, for instance, severe fuel consumption regulations are enforced in many countries under consideration of global environmental problems. As the solution, the development and use of hybrid cars capable of reducing the load of internal combustion engines is accelerated and widespread, and electric auxiliaries for electric power steering systems and electric oil pumps also become widespread. Electric motors for use in these applications must meet the requirements of low profile, light weight, and high performance. Nd and Sm-base sintered magnets are frequently used because of their superior properties.

These motors are recently required to further improve their performance. For the purpose of efficiency improvement, in many cases, sintered magnet blocks are divided into magnet pieces of small size, which are mounted in place. For the production of such divided magnet pieces of small size, a method of furnishing a magnet block of large size as starting stock and cutting the block into a multiplicity of magnet pieces is efficient. The known cutting means include multiple outer-diameter (OD) blades and multiple wire saws. In either case, in order to prevent magnet alloy chips from scattering and to ensure an accuracy of cut size, most methods and apparatus for cutting magnet alloy blocks are of batchwise production mode in that a sintered magnet block is cut into a multiplicity of pieces while the block is fixedly secured to a cutting jig by means of a clamp mechanism.

Referring to FIG. 8, a prior art apparatus including multiple OD blades is illustrated. A plurality of magnet blocks 1 are adhesively secured to a carbon jig 101, which is mounted on a slide table 102. The jig 101 is moved in the arrow direction at a predetermined speed while multiple OD blades 2 (six blades in the figure) are rotated in the arrow direction. The magnet blocks 1 together with the carbon jig 101 are continuously cutoff machined by the rotating blades 2. In this way, one magnet block is divided into a multiplicity of magnet pieces (five pieces in the figure).

This method for cutoff machining magnet blocks is described in detail. First a solid wax (e.g., Adfix series wax by Nikka Seiko Co., Ltd.) is melted by heating at a predetermined temperature and applied to the carbon jig 101. A plurality of magnet blocks 1 (twenty blocks in the figure) are arranged in cascade and adhesively secured to the carbon jig 101. The jig 101 is mounted on the slide table 102. At this point, the jig 101 is accurately positioned and fixedly secured by inserting spacers 103 and tightening three screws 104.

In this state, the slide table 102 is moved in the arrow direction, the multiple OD blades 2 are rotated at a high speed, and a coolant is supplied to the cutting site from a coolant supply nozzle 3. Each magnet block 1 is cutoff machined together with the carbon jig 101 surface by the rotating blades 2. One magnet block 1 is divided into five magnet pieces 11. After the completion of cutoff machining, the cutting apparatus is interrupted, the screws 104 are loosened, the carbon jig 101 is dismounted, the jig is heated again to melt the wax, and the magnet pieces 11 are removed from the jig 101. After cleaning with an organic solvent at elevated temperature and hot air drying, the magnet pieces 11 are recovered. Once any wax deposit remaining on the magnet-bonding surface of the jig is removed, the carbon jig 101 is ready for reuse, that is, subjected to the cutting operation again after new magnet blocks 1 are adhesively secured thereto. By repeating the cutting operation, magnet blocks 1 are cut into magnet pieces.

The batchwise production method mentioned above, however, involves appurtenant steps, setups and changeovers such as setting of magnet blocks in the jig, mounting and dismounting of the jig, heating and cleaning with organic solvent, which cause significant drops of operating capacity and productivity.

CITATION LIST

Patent Document 1: JP-A 2012-000708 (US 20110312255)

Patent Document 2: JP-A 2010-110851

DISCLOSURE OF INVENTION

An object of the invention is to provide a cutting apparatus for continuously cutoff machining a series of sintered rare earth magnet blocks each into a multiplicity of magnet pieces of desired shape and/or size in an efficient manner, the apparatus being successful in substantially improving the productivity of magnet pieces.

In one aspect, the invention provides a cutting apparatus for continuously cutoff machining a series of sintered magnet blocks each into a multiplicity of magnet pieces of desired shape and/or size, comprising a guide rail including a carrier path channeled in its upper surface for receiving and guiding a series of magnet blocks, and a cutoff section at a predetermined position, the guide rail being provided with a plurality of slits, a means for continuously extruding the magnet blocks to the guide rail, a holder plate disposed on the cutoff section of the guide rail for holding from above the magnet blocks which are moved forward along the guide rail, the holder plate being provided with a plurality of slits, and a plurality of OD blades having a cutting edge at their circumference, the OD blades being adapted to rotate about an axis extending perpendicular to the forward movement direction while the cutting edge is extended through the slit in the holder plate, across the carrier path and into the slit in the guide rail. The extruding means operates to continuously extrude a plurality of magnet blocks, to arrange them in the carrier path of the guide rail and to move them forward under a predetermined pressure at a predetermined speed, so that a cascade of magnet blocks are arranged and moved forward in the carrier path. When one magnet block is moved past the cutoff section, the OD blades cutoff machine the magnet block into a multiplicity of magnet pieces of desired shape and/or size while the holder plate holds the block in place. The multiplicity of magnet pieces are recovered from the guide rail downstream of the cutoff section.

Preferably, the cutting apparatus further comprises a means for supplying a coolant to a cutting site where the OD blades contact with the magnet block.

In a preferred embodiment, the plurality of OD blades are coaxially arranged at a predetermined spacing so that one magnet block is cutoff machined at a plurality of positions.

In a preferred embodiment, the holder plate includes a flat holding section which is disposed parallel to the guide rail and in abutment with the magnet blocks and upwardly bent attachment sections which are disposed at opposite ends of the holding section in the movement direction, the attachment sections being elastically deformable. The holder plate is mounted above the guide rail by connecting end portions of the attachment sections to portions of the apparatus.

Preferably, the cutting apparatus further comprises a means for biasing the holder plate downward to hold the magnet block under a predetermined pressure.

In another preferred embodiment, at least a part of the holder plate in abutment with the magnet block is corrugated.

In another aspect, the invention provides a method for continuously producing sintered magnet pieces of desired shape and/or size by continuously cutoff machining a series of magnet blocks using the cutting apparatus defined above.

In summary, the continuous cutting apparatus of the invention operates such that a series of sintered magnet blocks are arranged on the guide rail as a cascade, moved straight forward, and continuously cutoff machined by rotating OD blades at the predetermined position on the guide rail. The magnet block maintains the stable attitude as held by the holder plate until the magnet block is moved to the cutting site. Thus the magnet block at the stable attitude is cutoff machined. Since the magnet blocks are constantly extruded at the predetermined speed by the extruding means, a cascade of magnet blocks are arranged on the guide rail and moved forward at the constant speed in a stable manner. Thus cutoff machining by rotating OD blades is stable and effective.

With this continuous cutting apparatus, a series of sintered magnet blocks are continuously moved forward and cutoff machined by rotating OD blades. The cutting apparatus is capable of continuously cutoff machining a series of sintered magnet blocks each into a multiplicity of magnet pieces of desired shape and/or size in an efficient manner, eliminating appurtenant steps, setups and changeovers such as setting of magnet blocks in the jig, mounting and dismounting of the jig, heating and cleaning with organic solvent, as involved in the prior art batchwise production method. This achieves a significant increase in productivity of magnet pieces.

ADVANTAGEOUS EFFECTS OF INVENTION

The continuous cutting apparatus of the invention is effective for continuously cutoff machining a series of sintered magnet blocks each into a multiplicity of magnet pieces of desired shape and/or size. As compared with prior art apparatus of batchwise production mode, the invention achieves a significant increase in productivity and ensures efficient production of sintered magnet pieces.

DESCRIPTION OF PREFERRED EMBODIMENTS

As used herein, the terms "upstream" and "downstream" are used in conjunction with the forward (from left to right in all figures) movement of magnet blocks along the guide rail. Also the term "longitudinal" corresponds to the direction of movement of magnet blocks, and "lateral" corresponds to a direction perpendicular thereto. A magnet block is a substantially rectangular block or plate having a width in the lateral direction, a length in the longitudinal direction, and a thickness in a vertical direction (in FIG. 5). Although the cross section of the block is preferably rectangular (in all figures), the upper side may be domed or curved. Sintered magnet blocks to be divided are typically blocks of rare earth sintered magnet, for example, Nd or Sm-base sintered magnet although ferrite sintered magnets are also applicable.

Figure 1:
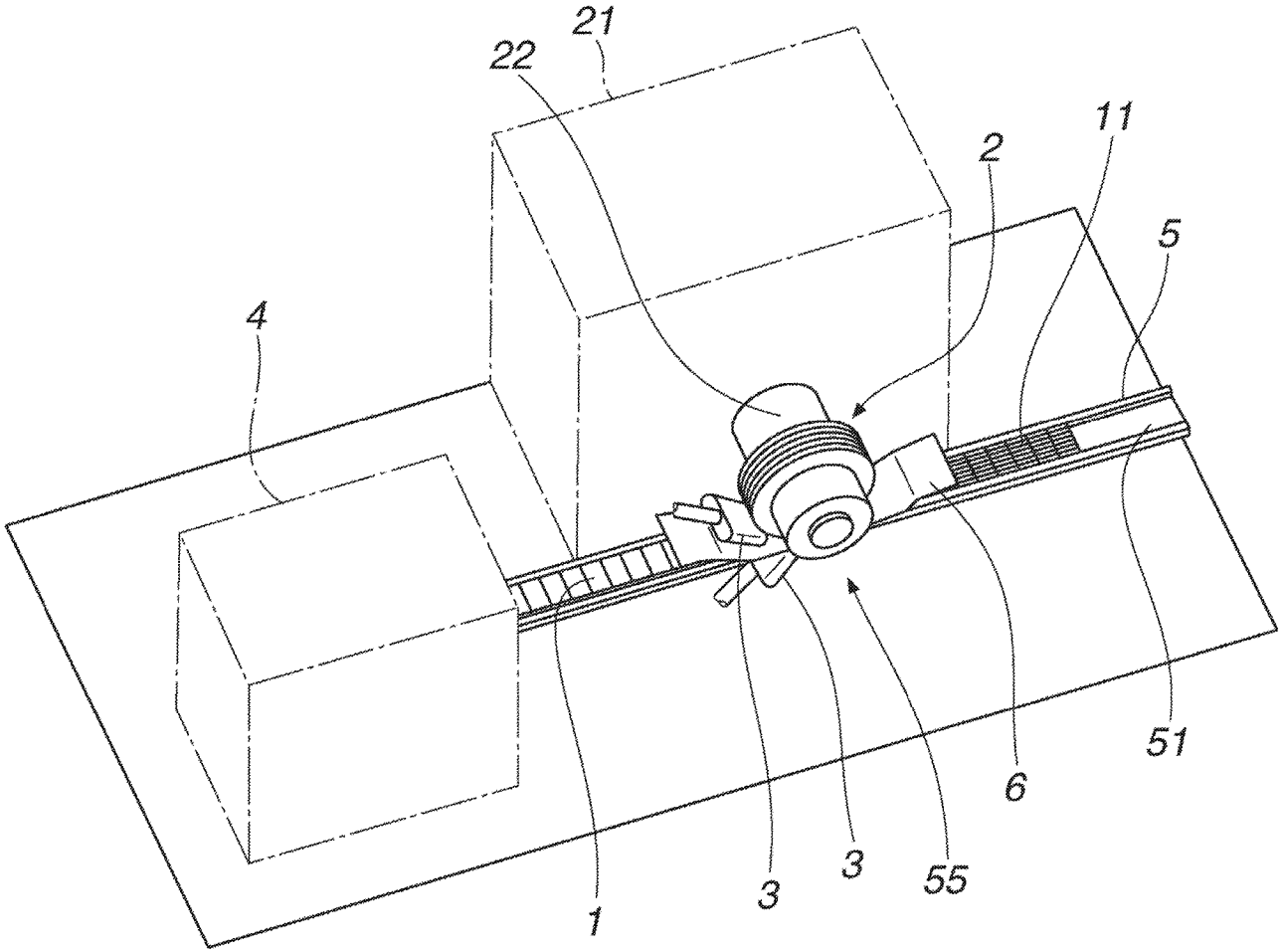
FIG. 1 is a schematic perspective view of a cutting apparatus in one embodiment of the invention.

Referring to FIG. 1, there is illustrated an apparatus for continuously cutting sintered magnet blocks according to one embodiment of the invention. Briefly stated, the continuous cutting apparatus includes a guide rail 5, a means (or extruder) 4 for extruding a series of sintered magnet blocks 1 onto the guide rail 5 so as to move forward a cascade of magnet blocks along the guide rail 5, and a plurality of outer-diameter (OD) blades 2 which are rotated to cutoff machine each magnet block (moving along the guide rail 5) into magnet pieces.

Figure 2:
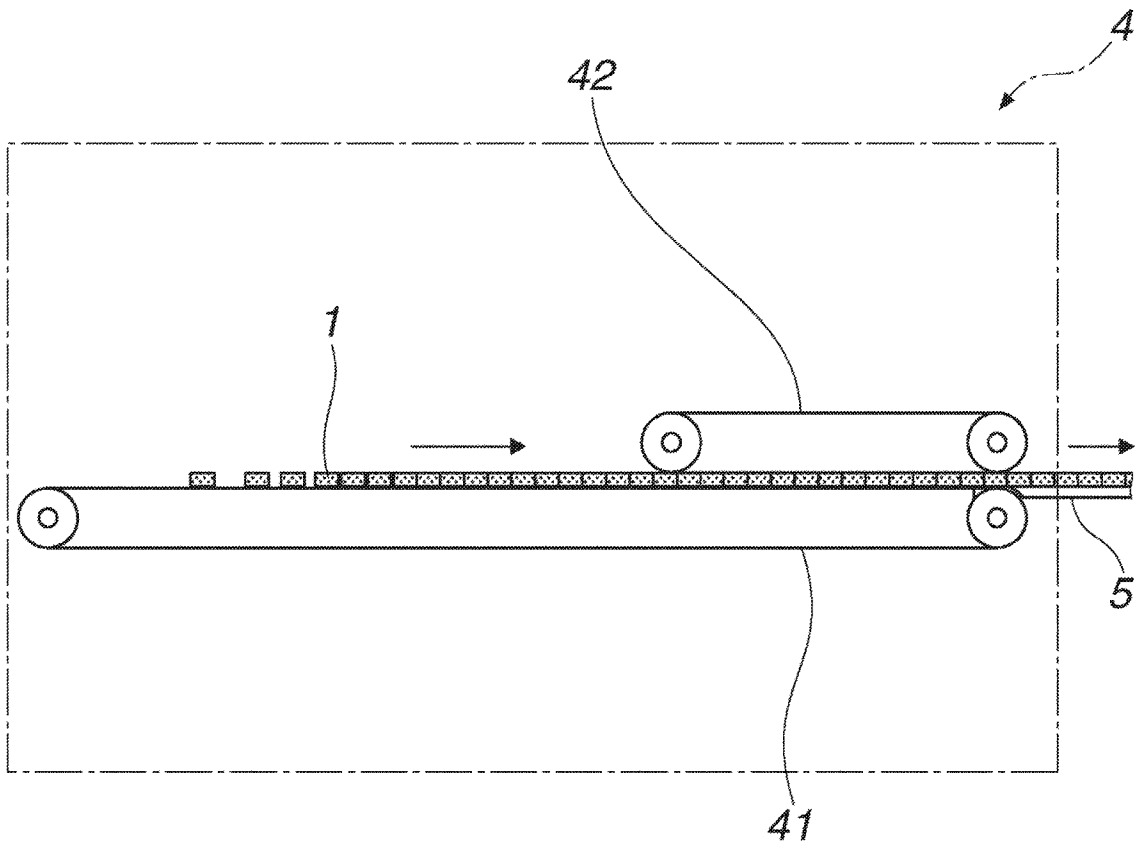
FIG. 2 is a schematic view of a magnet block extruding means in the cutting apparatus.

As shown in FIG. 2, the magnet block extruder 4 includes a lower extruding conveyor 41 having a relatively long convey surface and an upper extruding conveyor 42 having a relatively short convey surface, disposed above a downstream portion of the lower conveyor 41. The lower and upper conveyors 41 and 42 are disposed such that one convey surface is opposed and parallel to the other convey surface. The upper conveyor 42 is mounted for vertical motion and may be moved up and down by a lift mechanism (not shown), so that the magnet blocks 1 may be clamped between the lower and upper conveyors 41 and 42. The lower and upper conveyors 41 and 42 are driven by respective drives (not shown) so that their belts may move at a predetermined speed. The belts of the lower and upper conveyors 41 and 42 synchronously turn around clockwise and counter-clockwise, respectively, at the same speed. A cascade of magnet blocks 1 arranged on the lower conveyor 41 is clamped between the lower and upper conveyors 41 and 42 at a downstream belt portion of the lower conveyor 41 and continuously extruded onto the guide rail 5 under a predetermined pressure. As used herein, a cascade of magnet blocks means that magnet blocks are closely arrayed.

Figure 4:
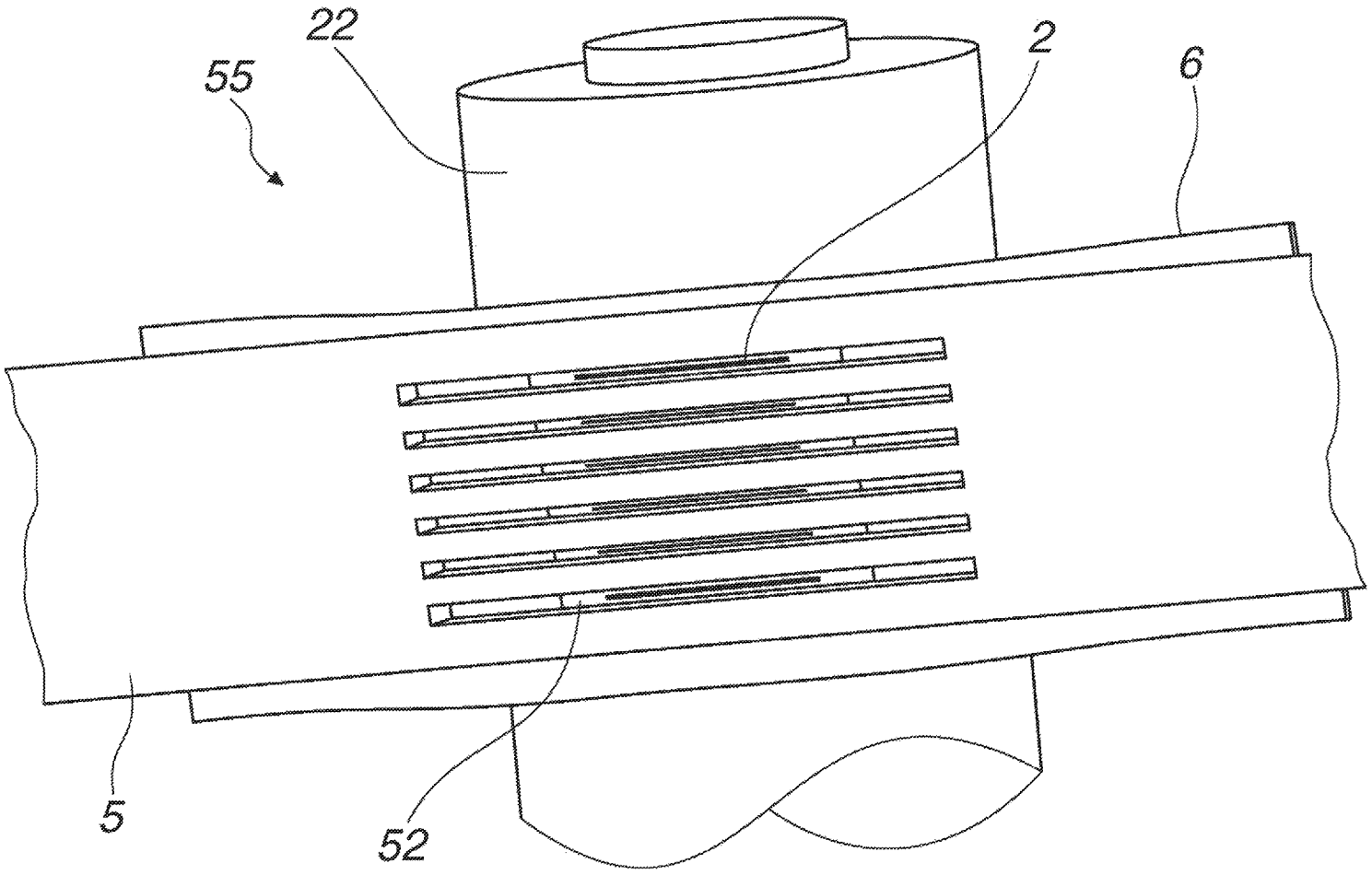
FIG. 4 is a schematic view as viewed from below of the cutoff section and OD blade assembly in the cutting apparatus.
Figure 5:
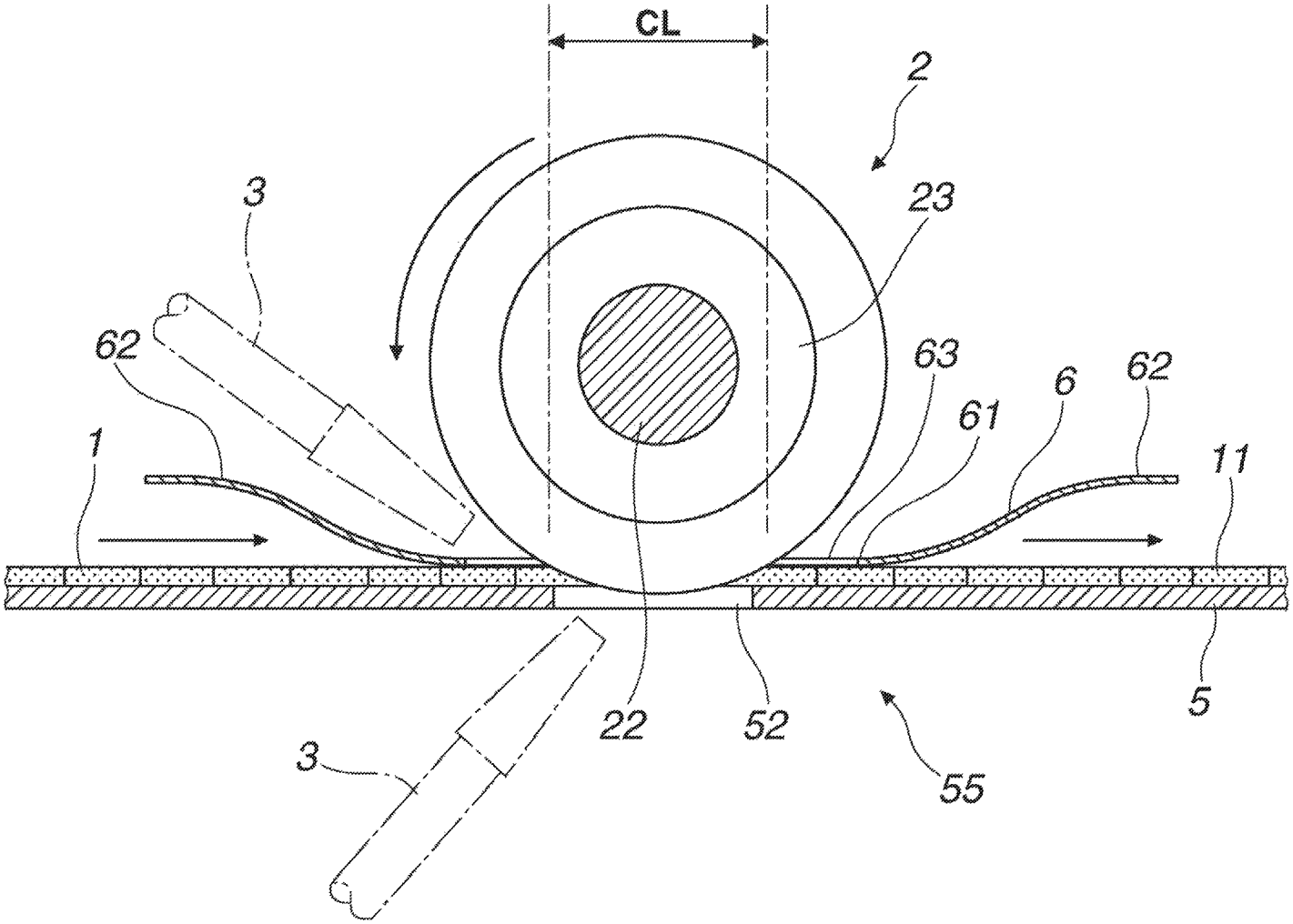
FIG. 5 is a longitudinal cross-sectional view of the cutoff section and OD blade assembly in the cutting apparatus.

The guide rail 5 includes a straight carrier path 51 channeled in its upper surface and defined by side walls for receiving and guiding a cascade of magnet blocks 1. By the continuous extruding action of the extruder 4, the cascade of magnet blocks 1 is continuously moved along the guide rail 5 from left to right as viewed in FIG. 1. The guide rail 5 is also provided with slits 52 in the bottom of the carrier path 51, which correspond to the OD blades 2 in a cutoff section 55 as shown in FIGS. 4 and 5. The cutting edge of the OD blade 2 is inserted into the corresponding slit 52 from above. It is noted that in the illustrated embodiment wherein six OD blades 2 are included, six slits 52 are formed in the guide rail 5. The length of the slit 52 is preferably 110% to 130% of the insertion length of the OD blade 2 (i.e., the length of an OD blade segment coplanar with the slit in FIG. 5). The width of the slit 52 is no more than 4 times the thickness of the OD blade 2 (see FIG. 4) and is such that the OD blade 2 may not contact therewith during rotation.

The carrier path 51 of the guide rail 5 is a straight channel for receiving and guiding magnet blocks 1. Side walls defining the carrier path 51 are lower than the thickness of magnet blocks 1. Then, when the magnet blocks 1 are moved along the carrier path 51, upper portions (in thickness direction) of the magnet blocks protrude beyond the side walls of the guide rail 5. The width of the carrier path 51 is substantially equal to the width of magnet blocks 1 so that the magnet blocks 1 may be smoothly moved along the carrier path 51 without substantial lateral wobble.

Figure 6:
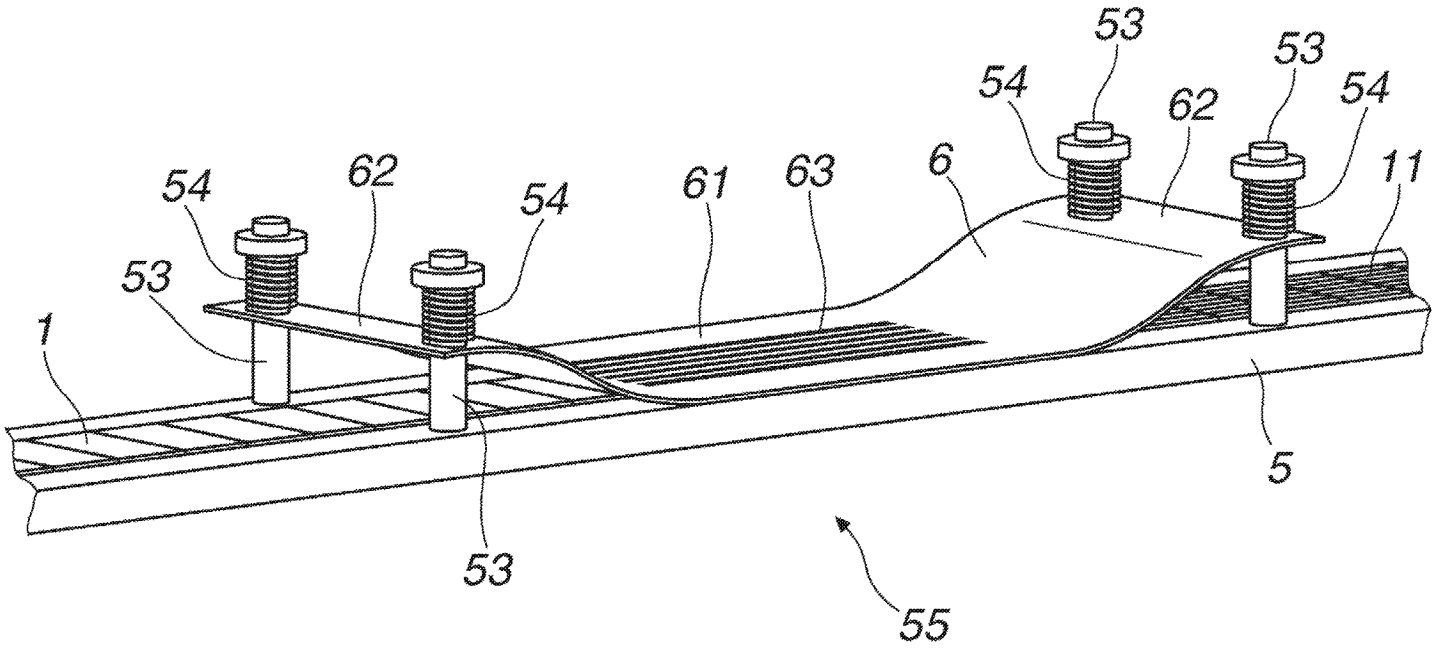
FIG. 6 is a perspective view of one exemplary holder plate in the cutting apparatus.

A holder plate 6 is mounted above the cutoff section 55 of the guide rail 5 where the slits 52 are formed, and between the OD blades 2 and the guide rail 5. As shown in FIGS. 5 and 6, the holder plate 6 includes a flat holding section 61 and elastically deformable attachment sections 62 having upwardly bent end portions. The flat holding section 61 is disposed parallel to the guide rail 5 and in abutment with the magnet blocks 1. The attachment sections 62 are engaged to four posts 53 standing on the guide rail 5 for vertical motion whereby the holder plate 6 is mounted. The central holding section 61 is disposed so as to cover from above the carrier path 51 in the guide rail 5. The holding section 61 covering the carrier path 51 is provided with slits 63 corresponding to the OD blades 2. As shown in FIG. 5, the cutting edges of the OD blades 2 are extended from above through the slits 63 and across the carrier path 51 of the guide rail 5, and partially inserted into the slits 52 in the guide rail 5. It is noted that in the illustrated embodiment wherein six OD blades 2 are included, six slits 52 are formed in the guide rail 5, and six slits 63 are formed in the holder plate 6. The length of the slit 63 is preferably 120% to 150% of the insertion length of the OD blade 2 (i.e., the length of an OD blade segment coplanar with the slit in FIG. 5). The width of the slit 63 is no more than 5 times the thickness of the OD blade 2 and is such that the OD blade 2 may not contact therewith during rotation.

As shown in FIG. 6, biasing means in the form of springs 54 are mounted on the posts 53 for biasing the holder plate 6 downward under a predetermined pressure. The biasing force of the springs 54 and the elastic force of the bent attachment sections 62 help the holder plate 6 hold the magnet blocks 1, which are moved forward along the carrier path 51 of the guide rail 5, under a predetermined pressure, so that each magnet block 1 may be held in place, i.e., at a stable attitude upon cutting by the OD blades 2. The holding section 61 of the holder plate 6 for holding the magnet block 1 preferably has a length of 150% to 200% of the cutting length CL (see FIG. 5) over which the cutting edge of OD blade 2 is inserted into the magnet block 1. With this construction, the holder plate 6 effectively holds not only one magnet block being actually cut, but also one upstream magnet block and one downstream magnet block, leading to an improvement in cutoff dimensional accuracy. It is noted that the springs (holder plate biasing means) 54 are not essential. In some cases, the springs 54 are omitted, and the magnet block 1 is held only by the elastic force of the attachment sections 62.

Figure 7:
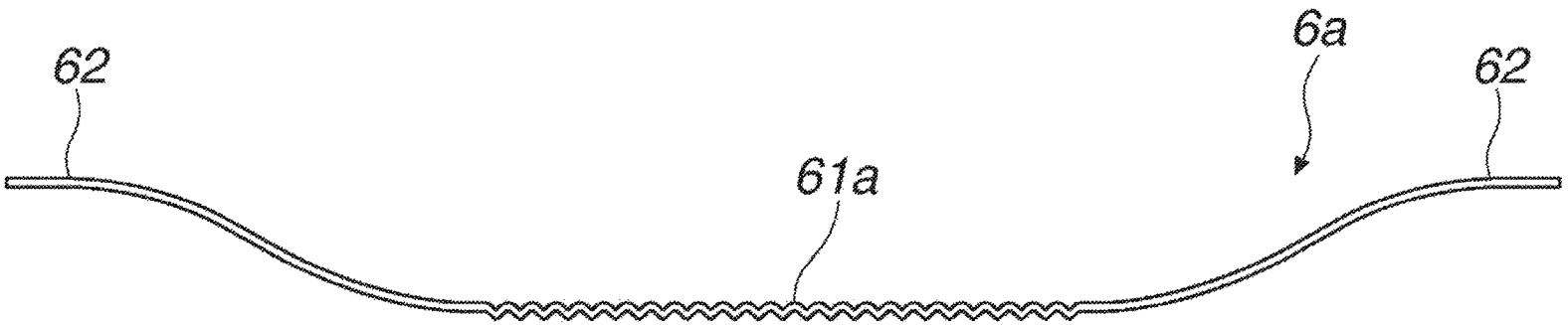
FIG. 7 is an elevational view of another exemplary holder plate in the cutting apparatus.

The holder plate 6 serves to hold or press the magnet blocks 1 which are moved forward along the carrier path 51 of the guide rail 5. It is desired to reduce frictional resistance to the movement of the magnet blocks 1 without losing the pressing force. As shown in FIG. 7, another exemplary holder plate **6*a* includes a holding section 61*a* which is corrugated in cross section to reduce the contact area with the magnet block 1. This holder plate 6*a* is effective for reducing frictional resistance with the magnet blocks 1 without a loss of the pressing force. In this embodiment, the pitch (or crest-to-crest distance) of corrugations is preferably up to 20 mm, though it varies depending on the size of magnet blocks 1 and magnet pieces 11 after cutoff. For example, the pitch may be about 8 mm when magnet blocks 1** have a length of 10 to 30 mm in the cutting direction.

Figure 3:
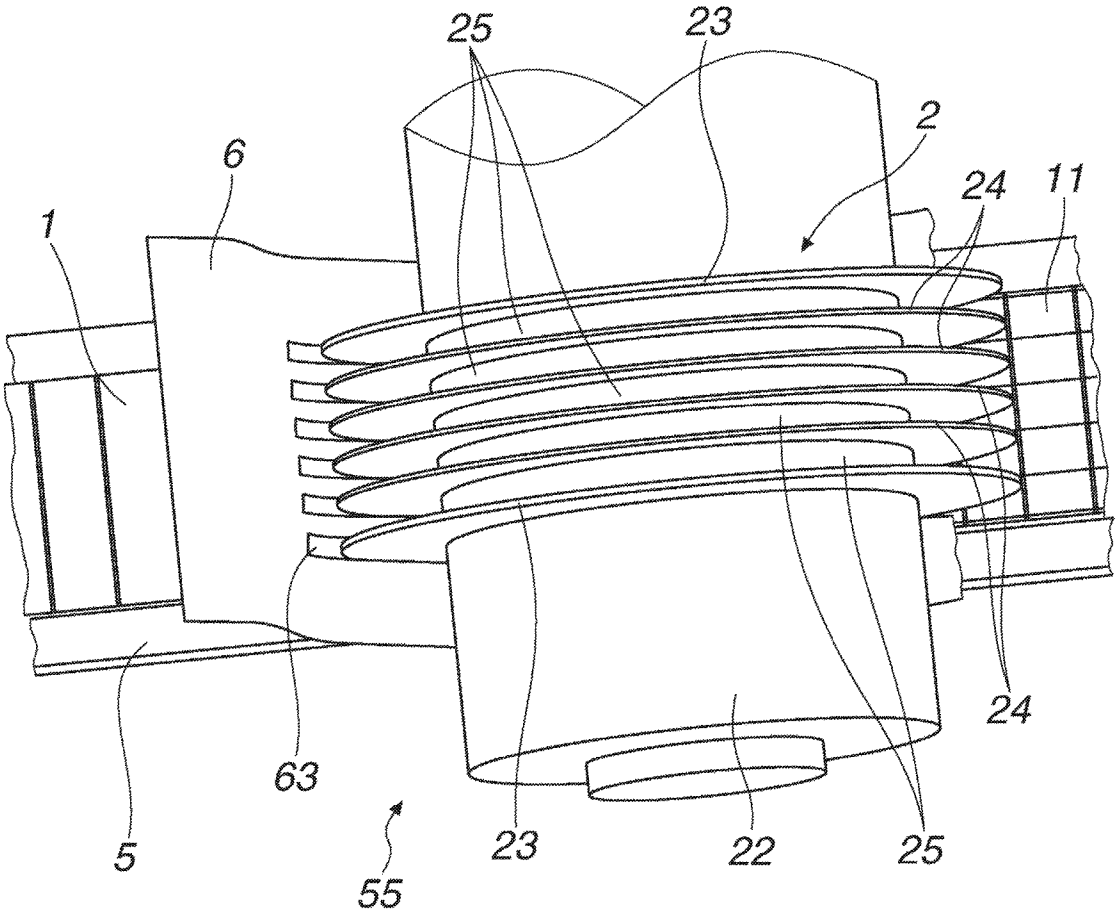
FIG. 3 is a schematic view as viewed from above of a cutoff section and OD blade assembly in the cutting apparatus.

As best shown in FIGS. 3 to 5, a multiple blade assembly includes a plurality of outer-diameter (OD) blades 2 which are coaxially mounted on a rotating shaft 22 at axially spaced apart positions, each OD blade 2 including a circular or annular disk and a cutting edge on the circumference of the disk. The shaft 22 is extended laterally, i.e., perpendicular to the movement direction of magnet blocks 1. In the illustrated embodiment, the assembly includes coaxially mounted six OD blades 2 which are spaced apart at predetermined intervals by spacers 25. The shaft 22 is coupled to a drive mechanism 21 (shown simply in FIG. 1) for rotating the OD blades 2 at a predetermined speed. While the multiple blade assembly is positioned such that the cutting edges of OD blades 2 are extended from above into the slits 63 in the holder plate 6 and across the carrier path 51 of the guide rail 5, and partially inserted into the slits 52 in the guide rail 5, the OD blades 2 are rotated to cutoff machine each of the magnet blocks 1, which are moved along the carrier path 51 of the guide rail 5, into a multiplicity of magnet pieces. Notably, as viewed in FIG. 5, the magnet blocks 2 are moved from left to right (or forward), and the OD blades 2 are rotated counterclockwise, suggesting that cutoff machining is performed by the so-called "down-cut grinding".

Where the multiple blade assembly includes at least three OD blades 2, for example, six OD blades 2 in the illustrated embodiment, preferably two outside OD blades 23 assigned to cut lateral end portions of the magnet block 1 are thicker than four inside OD blades 24. In the Experiment described later, for example, inside blades 24 have an axial thickness of 0.5 mm, and outside blades 23 have an axial thickness of 1.5 mm. The outside blades 23, which are made thick and thus rigid, ensure that they are laterally aligned during cutting of the magnet block 1, resulting in a high dimensional accuracy of cutoff machining.

As shown in FIG. 1, a coolant supply means in the form of supply nozzles 3 is disposed upstream of the multiple blade assembly for supplying a coolant (e.g., water-soluble grinding fluid dilution or slurry) from a conduit (not shown) to the cutting site of the magnet block 1 by the OD blades 2. The coolant supply nozzles 3 are disposed above and below the guide rail 5 as best shown in FIG. 5, so that the coolant is injected to the cutting site through the slits 63 in the holder plate 6 and the slits 52 in the guide rail 5.

It is described how to cutoff machine one magnet block 1 into five magnet pieces 11 using the continuous cutting apparatus.

As shown in FIG. 2, magnet blocks 1 to be divided are continuously fed to an upstream side of the lower conveyor 41 of the magnet extruder 4 to arrange a cascade of magnet blocks 1 on the lower conveyor 41. The cascade of magnet blocks 1 is clamped between the upper and lower conveyors 42 and 41 and extruded forward onto the carrier path 51 of the guide rail 5 under a predetermined pressure and at a predetermined speed. At the same time, the drive mechanism 21 is actuated to rotate the OD blades 2 at a predetermined speed, and coolant is injected from the supply nozzles 3 toward the cutting edges of the rotating OD blades 2.

As the magnet blocks 1 are delivered from the extruder 4 to the guide rail 5, a cascade of magnet blocks are arranged in the carrier path 51 of the guide rail 5 and moved forward along the carrier path 51 with upper portions (in thickness direction) of the magnet blocks 1 being protruded beyond the side walls of the guide rail 5. Then the magnet blocks 1 are moved below the holder plate 6 in the cutoff section 55, and moved further while being held downward by the holder plate 6. In this state, one magnet block 1 is cutoff machined into five magnet pieces 11 by the rotating OD blades 2 under the continuous supply of the coolant. The cut magnet pieces 11 are recovered downstream of the guide rail 5.

In the cutting step, the magnet block 1 is laterally restrained by the side walls defining the carrier path 51, longitudinally (movement direction) clamped between upstream and downstream adjacent magnet blocks 1 by the pushing force of the extruder 4, and vertically restrained by the pressing force of the holder plate 6. Thus the magnet block 1 is cutoff machined while being kept in the fully stable attitude, ensuring a high dimensional accuracy of cutting. As a series of magnet blocks 1 are continuously extruded at the predetermined speed and moved forward along the carrier path 51, continuous cutoff machining of the series of magnet blocks is possible. That is, cutoff machining is possible at a high dimensional accuracy.

The rotational speed of OD blades 2 and the moving speed (or cutting speed) of magnet blocks 1 are not particularly limited, and they may be determined depending on the properties (e.g., hardness) and size of magnet blocks 1, and the cutting ability of the OD blade cutting edge. For example, in the Experiment wherein blocks of rare earth sintered magnet, typically Nd or Sm-base sintered magnet are cutoff machined by OD blades having a cutting edge portion of resin-bonded diamond abrasive grains, the rotational speed of the OD blades may be in a range of 1,000 to 15,000 rpm, more preferably 3,000 to 10,000 rpm and the moving (or cutting) speed may be in a range of 20 to 500 mm/min, more preferably 50 to 300 mm/min.

Also preferably, each magnet block has been polished on at least four surfaces, that is, the side surfaces of the magnet block in the longitudinal (movement) direction at which magnet blocks contact with each other, and the upper and lower surfaces of the magnet block which come in contact with the holder plate 6 and the guide rail 1 in the thickness direction, so that the magnet blocks 1 may be smoothly moved along the carrier path 51 of the guide rail 5.

As illustrated above, the continuous cutting apparatus of the invention operates such that a series of sintered magnet blocks 1 are arranged on the guide rail 5 as a cascade, moved straight forward, and continuously cutoff machined by rotating OD blades 2 at the predetermined position on the guide rail 5. Each magnet block 1 maintains the stable attitude as held by the holder plate 6 until the magnet block is moved to the cutting site. Thus the magnet block in the stable attitude is cutoff machined. Since the magnet blocks are constantly extruded at the predetermined speed by the extruder 4, a cascade of magnet blocks are arranged on the guide rail 5 and moved forward at the predetermined speed in a stable manner. Thus the cutoff machining by rotating OD blades 2 is stable and effective.

With this continuous cutting apparatus, a series of sintered magnet blocks are continuously moved forward and cutoff machined by rotating OD blades. The cutting apparatus is capable of continuously cutoff machining a series of sintered magnet blocks each into a multiplicity of magnet pieces of desired shape and/or size. The invention eliminates appurtenant steps, setups and changeovers such as setting of magnet blocks in the jig, mounting and dismounting of the jig, heating and cleaning with organic solvent, as involved in the prior art batchwise production method. The invention achieves a significant increase in productivity of magnet pieces.

EXAMPLES

Experiments are given below for further illustrating the benefits of the invention.

Figure 8:
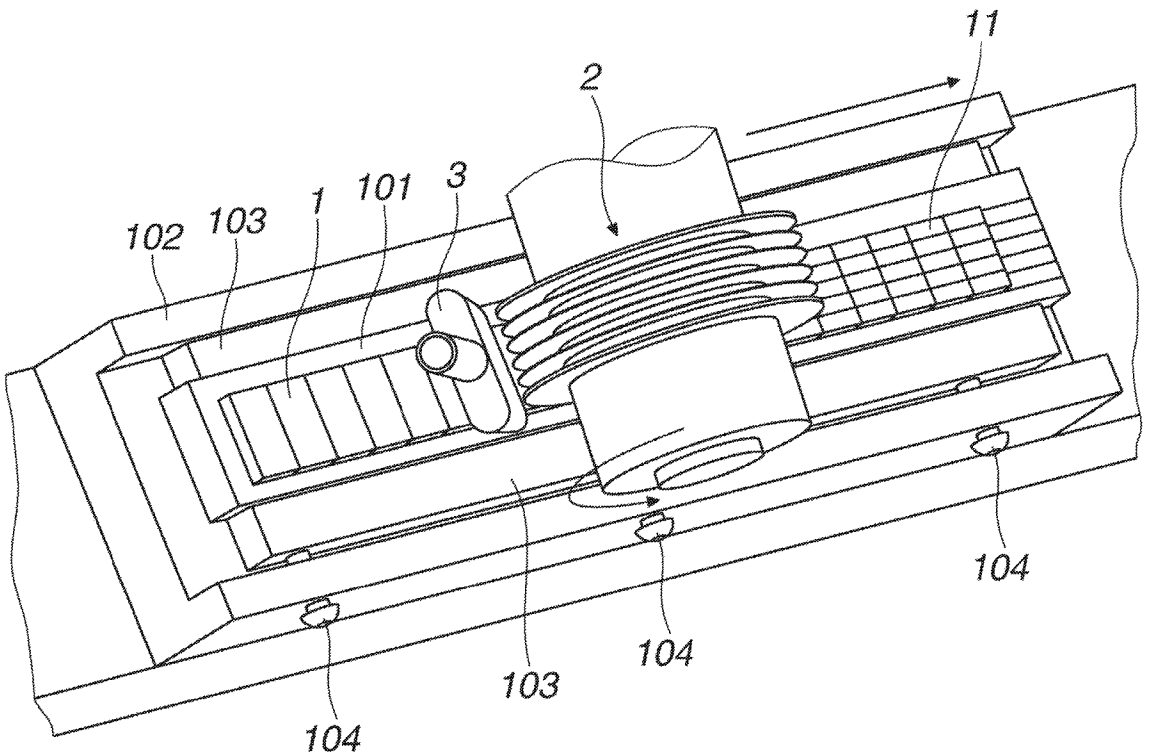
FIG.8 PRIOR ART
FIG. 8 is a schematic perspective view of a prior art cutting apparatus.

Using the continuous cutting apparatus shown in FIGS. 1 to 6 (Example) and the prior art batchwise cutting apparatus shown in FIG. 8 (Comparative Example), each of magnet blocks was cutoff machined into 5 magnet pieces according to the above-mentioned procedures. The dimensional accuracy and productivity of magnet pieces were evaluated.

[Common parameters of Example and Comparative Example]

Magnet Block 1

There were furnished Nd-base sintered rare earth magnet blocks (40 mm×20 mm×5 mm) of rectangular cross section which had been ground on all surfaces to an accuracy of ±0.1 mm.

Magnet Piece 11

The magnet block was cutoff machined into five magnet pieces 11 of 7 mm×20 mm×5 mm.

OD Blades 2

OD blades each had a cutting edge portion of resin-bonded diamond abrasive grains at the circumference of a cemented carbide disk. A multiple blade assembly included two outside OD blades 23 having an outer diameter of 120 mm and a thickness of 1.5 mm, and four inside OD blades 24 having an outer diameter of 120 mm and a thickness of 0.5 mm. The blades were rotated at a speed of 6,000 rpm and in a direction of down-cut grinding.

Cutting Speed

The cutting speed (i.e., moving speed of magnet blocks) was 100 mm/min.

Coolant

A water-soluble grinding fluid dilution was supplied at a flow rate of 20 L/min as the coolant.

[Parameters in Example]

Holder Plate 6

The holder plate 6 had a thickness of 0.5 mm, included a holding section 61 having a length of 100 mm and slits 63 having a length of 90 mm and a width of 2 mm for the outside blades 23 and 1 mm for the inside blades 24.

Guide Rail 5

The guide rail 5 was provided with slits 52 having a length of 50 mm and a width of 2 mm for the outside blades 23 and 1 mm for the inside blades 24.

[Parameters in Comparative Example]

Mounting of Magnet Blocks to Jig

A solid wax (Adfix series wax by Nikka Seiko Co., Ltd.) was applied to a carbon jig 101 (450 mm×50 mm×20 mm) which was heated on a hot plate at 140° C. whereby the wax was melted and coated thereto. Twenty magnet blocks 1 were arranged in cascade on the carbon jig 101, which was cooled to room temperature whereby the blocks were adhesively secured to the jig. The jig 101 was mounted on the slide table 102 and fixedly secured by the screws 104. This was followed by cutting operation.

Post-cutting Operation

The jig 101 was removed from the slide table 102 and heated on a hot plate at 140° C. whereupon magnet pieces 11 as cut were detached from the jig 101. The magnet pieces 11 were heat cleaned with an organic solvent and dried with hot air, before recovery. The wax residue was removed from the jig 101, which was ready for reuse.

By the cutoff operation of either mode, 1,000 magnet pieces were obtained. Using a digital micrometer, the size (width) of each magnet piece was measured at five points including four corners and one center of a cut surface. In this way, the magnet pieces were examined for a variation from the set width of 7 mm. The results are shown below.

Variation (Max−Min) of cut width

Apparatus of Example: 0.105 mm

Apparatus of Comparative Example: 0.108 mm

It has been demonstrated that the apparatus of Example achieves an equal level of dimensional accuracy to the prior art apparatus of Comparative Example. In the cutoff operation by the apparatus of Example, a substantial improvement in apparatus availability is achieved by a saving of setup time and continuous cutoff operation. The productivity is improved 50% over the prior art apparatus of Comparative Example.

Japanese Patent Application No. 2015-192779 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A cutting apparatus for continuously cutoff machining a series of sintered magnet blocks each into a multiplicity of magnet pieces of desired shape and/or size, comprising a guide rail including a carrier path channeled in its upper surface for receiving and guiding a series of magnet blocks, and a cutoff section at a predetermined position, the guide rail being provided with a plurality of slits, a means for continuously extruding the magnet blocks to the guide rail, a holder plate disposed on the cutoff section of the guide rail for holding from above the magnet blocks which are moved forward along the guide rail, the holder plate being provided with a plurality of slits, and a plurality of OD blades having a cutting edge at their circumference, the OD blades being adapted to rotate about an axis extending perpendicular to the forward movement direction while the cutting edge is extended through the slit in the holder plate, across the carrier path and into the slit in the guide rail, wherein said extruding means operates to continuously extrude a plurality of magnet blocks, to arrange them in the carrier path of the guide rail and to move them forward under a predetermined pressure at a predetermined speed, so that a cascade of magnet blocks are arranged and moved forward in the carrier path, when one magnet block is moved past the cutoff section, the OD blades cut the magnet block into a multiplicity of magnet pieces of desired shape and/or size while the holder plate holds the block in place, the multiplicity of magnet pieces are recovered from the guide rail downstream of the cutoff section.

2. The cutting apparatus of claim 1, further comprising a means for supplying a coolant to a cutting site where the OD blades contact with the magnet block.

3. The cutting apparatus of claim 1, wherein the plurality of OD blades are coaxially arranged at a predetermined spacing so that one magnet block is cutoff machined at a plurality of positions.

4. The cutting apparatus of claim 1 wherein the holder plate includes a flat holding section which is disposed parallel to the guide rail and in abutment with the magnet blocks and upwardly bent attachment sections which are disposed at opposite ends of the holding section in the movement direction, the attachment sections being elastically deformable, and the holder plate is mounted above the guide rail by connecting end portions of the attachment sections to portions of the apparatus.

5. The cutting apparatus of claim 1, further comprising a means for biasing the holder plate downward to hold the magnet block under a predetermined pressure.

6. The cutting apparatus of claim 1 wherein at least a part of the holder plate in abutment with the magnet block is corrugated.

7. A method for continuously producing sintered magnet pieces of desired shape and/or size by continuously cutoff machining a series of magnet blocks using the cutting apparatus of claim 1.

* * * * *